US008584309B2

(12) United States Patent
Santiago

(10) Patent No.: US 8,584,309 B2
(45) Date of Patent: Nov. 19, 2013

(54) AUXILIARY SUCTION NOZZLE AND PORT FOR VACUUM CLEANER

(75) Inventor: Jose Carlito Santiago, Belmont, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 13/592,521

(22) Filed: Aug. 23, 2012

(65) Prior Publication Data

US 2013/0047370 A1 Feb. 28, 2013

Related U.S. Application Data

(60) Provisional application No. 61/526,460, filed on Aug. 23, 2011.

(51) Int. Cl.
*A47L 5/32* (2006.01)

(52) U.S. Cl.
USPC ..... 15/331; 15/334; 15/337; 15/416

(58) Field of Classification Search
USPC ..... 15/331, 334, 337, 416
IPC ..... A47L 5/32
See application file for complete search history.

(56) References Cited

U.S. PATENT DOCUMENTS

| | | | |
|---|---|---|---|
| 1,217,817 | A | 2/1917 | Peters |
| 2,266,075 | A | 12/1941 | Replogle |
| 2,876,481 | A | 3/1959 | Gerber et al. |
| 3,906,575 | A | 9/1975 | Liebscher |
| 3,978,539 | A | 9/1976 | Yonkers |
| 4,007,508 | A | 2/1977 | Ooyachi |
| 4,023,234 | A | 5/1977 | Martinec et al. |
| 4,177,533 | A | 12/1979 | Liebscher et al. |
| 4,198,727 | A | 4/1980 | Farmer |
| 4,219,902 | A | 9/1980 | DeMaagd |
| 4,563,790 | A | 1/1986 | Clark |
| 4,811,452 | A | 3/1989 | Sumerau |
| 5,903,955 | A | 5/1999 | Farone et al. |
| 5,911,261 | A | 6/1999 | Farone et al. |
| 5,970,558 | A | 10/1999 | Canavan et al. |
| 6,039,817 | A | 3/2000 | Payne |
| 6,094,776 | A | 8/2000 | Fish |
| 6,381,802 | B2 | 5/2002 | Park |
| 6,421,874 | B1 | 7/2002 | McCormick |
| 6,510,584 | B2 | 1/2003 | Vystricil et al. |
| 6,514,356 | B2 | 2/2003 | Vystricil et al. |
| 6,523,222 | B2 | 2/2003 | Vystricil et al. |
| 6,951,045 | B2 | 10/2005 | Thur et al. |
| 7,013,521 | B2 | 3/2006 | Grey |
| 7,055,211 | B2 | 6/2006 | Tucker |
| 7,117,556 | B2 | 10/2006 | Grey |
| 7,146,682 | B2 | 12/2006 | Damman et al. |
| 7,290,309 | B2 | 11/2007 | Rocke |
| 7,293,325 | B2 | 11/2007 | Moshenrose et al. |

(Continued)

FOREIGN PATENT DOCUMENTS

| | | | |
|---|---|---|---|
| GB | 2137486 | A | 10/1984 |
| GB | 2213047 | A | 9/1989 |
| JP | 58061153 | U1 | 4/1983 |
| WO | 03024292 | A2 | 3/2003 |

*Primary Examiner* — David Redding
(74) *Attorney, Agent, or Firm* — McGarry Bair PC

(57) ABSTRACT

A vacuum cleaner includes an auxiliary suction nozzle in fluid communication with an auxiliary port provided on the vacuum cleaner. A vacuum hose can be coupled with the auxiliary port to establish fluid communication between the auxiliary suction nozzle and a source of suction.

16 Claims, 10 Drawing Sheets

(56) References Cited

U.S. PATENT DOCUMENTS

| | | | |
|---|---|---|---|
| 7,293,326 | B2 | 11/2007 | Hawkins et al. |
| 7,331,078 | B2 | 2/2008 | Grey |
| 7,549,190 | B2 | 6/2009 | Oh et al. |
| 7,571,509 | B2 | 8/2009 | Rosenzweig et al. |
| 7,610,651 | B2 | 11/2009 | Baek |
| 7,707,682 | B2 | 5/2010 | Parr |
| 2006/0000040 | A1 | 1/2006 | Grey et al. |
| 2007/0113361 | A1 | 5/2007 | Reese et al. |
| 2008/0022485 | A1 | 1/2008 | Grey |
| 2009/0300873 | A1 | 12/2009 | Grey |

AUXILIARY SUCTION NOZZLE AND PORT FOR VACUUM CLEANER

CROSS-REFERENCE TO RELATED APPLICATION

This application claims the benefit of U.S. Provisional Patent Application No. 61/526,460, filed Aug. 23, 2011, which is incorporated herein by reference in its entirety.

BACKGROUND OF THE INVENTION

Vacuum cleaners typically have one main suction nozzle in fluid communication with a source of suction. The main suction nozzle therefore forms an inlet for dirt and other debris to be suctioned into the vacuum cleaner. Vacuum cleaners also have been provided with means for cleaning along edges or baseboards of rooms and near kick plates of cabinetry and appliances. Such means include providing a vacuum hose between the main suction nozzle and the suction source that can be selectively removed from communication with the main suction nozzle. When the vacuum hose is removed from the main suction nozzle, suction is generated at the inlet of the vacuum hose. Examples of a vacuum cleaner having an edge cleaning tool which can be selectively coupled to a hose is shown in U.S. Pat. No. 5,903,955 to Farone et al., issued May 18, 1999 and U.S. Pat. No. 5,911,261 to Farone et al., issued Jun. 15, 199.

It is also known to direct at least a portion of the suction force of the main suction nozzle toward the side or edge of the vacuum cleaner to achieve better edge cleaning One example of a vacuum cleaner having an edge cleaner in fluid communication with a main suction nozzle is shown in U.S. Pat. No. 6,514,356 to Vystrcil et al., issued Feb. 4, 2003. Another example is U.S. Pat. No. 6,039,817 to Payne, issued Mar. 21, 2000, in which a valve assembly is used to selectively direct suction to a main suction nozzle or to a pair of side suction nozzles.

BRIEF DESCRIPTION OF THE INVENTION

A vacuum cleaner according to the invention comprises a housing having a main suction nozzle and an auxiliary suction nozzle that is fluidly isolated from the main suction nozzle, a vacuum hose alternatively in fluid communication with one of the main suction nozzle and the auxiliary suction nozzle, a suction source in fluid communication with the vacuum hose for generating a working air flow at the one of the main suction nozzle and the auxiliary suction nozzle, a port provided in the housing in fluid communication with the auxiliary suction nozzle, wherein the vacuum hose is removably coupled to the port when the vacuum hose is in fluid communication with the auxiliary suction nozzle, and a moveable door provided on the housing and selectively closing the port when the vacuum hose is uncoupled from the port.

DETAILED DESCRIPTION

The present invention relates generally to a live hose for the foot or base of a vacuum cleaner. For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
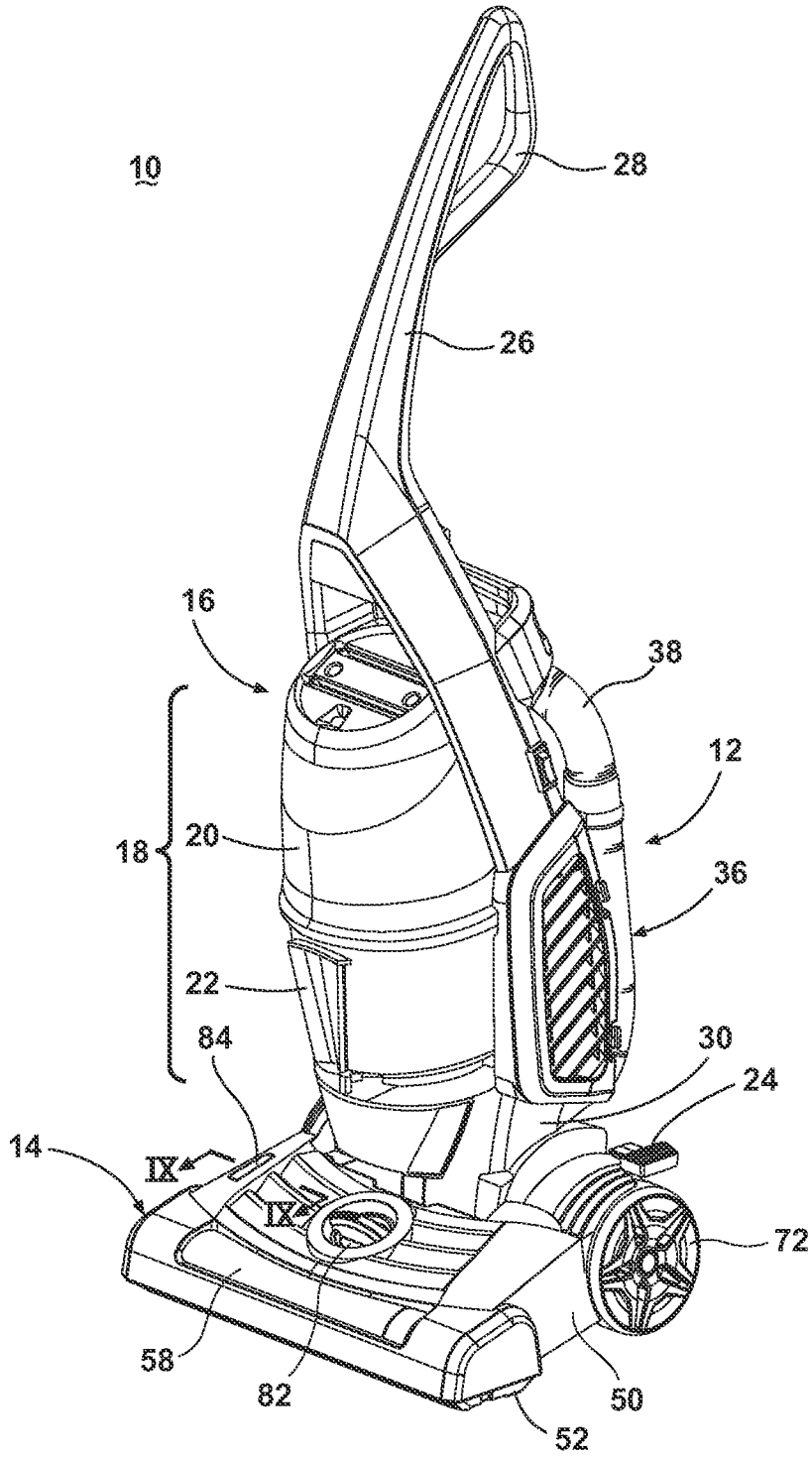
FIG. 1 is a front perspective view of a vacuum cleaner with base assembly pivotally attached to an upright handle assembly, and an auxiliary suction port in the base assembly which can selective receive a live hose assembly according to a first embodiment of the invention.
Figure 2:
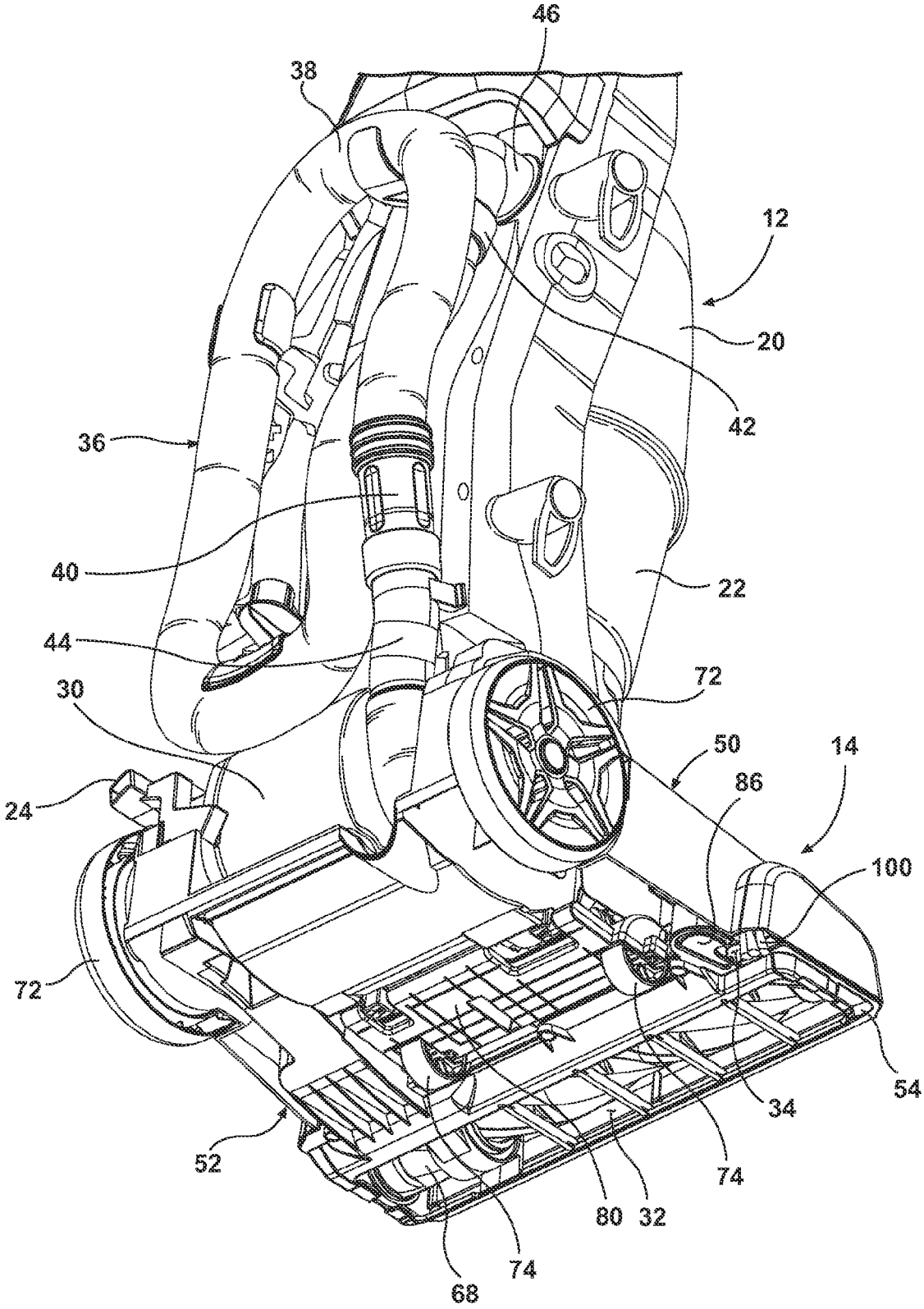
FIG. 2 is a rear perspective view of the vacuum cleaner of FIG. 1, with the live hose assembly illustrated in a first use position.

FIGS. 1 and 2 are front and rear perspective views of a vacuum cleaner 10 according to a first embodiment of the invention. As illustrated, the vacuum cleaner 10 comprises an upright handle assembly 12 pivotally mounted to a base assembly 14. The upright handle assembly 12 generally comprises a main body 16 housing a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. In another conventional arrangement, the collection system 18 can include an integrally formed cyclone separator and dirt cup, with the dirt cup being provided with a bottom-opening dirt door for contaminant disposal. In yet another conventional arrangement, the collection system 18 can include a filter bag. The vacuum cleaner 10 can also be provided with one or more additional filters upstream or downstream of the collection system 18. Other details of a suitable upright handle assembly 12 are more fully described in detail in U.S. Pat. No. 7,708,789 to Fester, which is incorporated herein by reference in its entirety.

The upright handle assembly 12 is pivotally mounted to the base assembly 14 for movement between an upright storage position, shown in FIG. 1, and a reclined use position (not shown). The vacuum cleaner 10 can be provided with a detent mechanism, such as a pedal 24 pivotally mounted to the base assembly 14, for selectively releasing the upright handle assembly 12 from the storage position to the use position. The details of such a detent pedal 24 are commonly known in the art, and will not be discussed in further detail herein.

The main body 16 also has an upwardly extending handle 26 that is provided with a hand grip 28 at one end that can be used for maneuvering the vacuum cleaner 10 over a surface to be cleaned. A motor cavity 30 is formed at a lower end of the main body 16 and contains a conventional suction source (not shown), such as a motor/fan assembly, positioned therein in selective fluid communication with a main suction nozzle 32 and an auxiliary suction nozzle 34, both of which are provided on the underside of the base assembly 14 and which are fluidly isolated from each other. The main suction nozzle 32 effectively forms a primary floor cleaning nozzle opening, which can perform the majority of the on-the-floor cleaning action, while the auxiliary suction nozzle 34 forms a secondary floor cleaning nozzle opening, which can perform auxiliary on-the-floor cleaning along areas of the surface that are typically harder with reach with the main suction nozzle 32, such as along edges or baseboards of rooms and near kick plates of cabinetry and appliances.

The vacuum cleaner 10 further comprises a live hose assembly 36 comprising an elongated, flexible vacuum hose 38 having a first coupling end 40 and a second coupling end 42 opposite the first coupling end 40. The first coupling end 40 is removably coupled to a hose receiver conduit 44 on the rear side of the vacuum cleaner 10 in fluid communication with the main suction nozzle 32 for on-the-floor cleaning The second coupling end 42 is attached to an inlet duct 46 in fluid communication with the cyclone separator 20, which places the main suction nozzle 32 in fluid communication with the suction source in the motor cavity 30.

Figure 3:
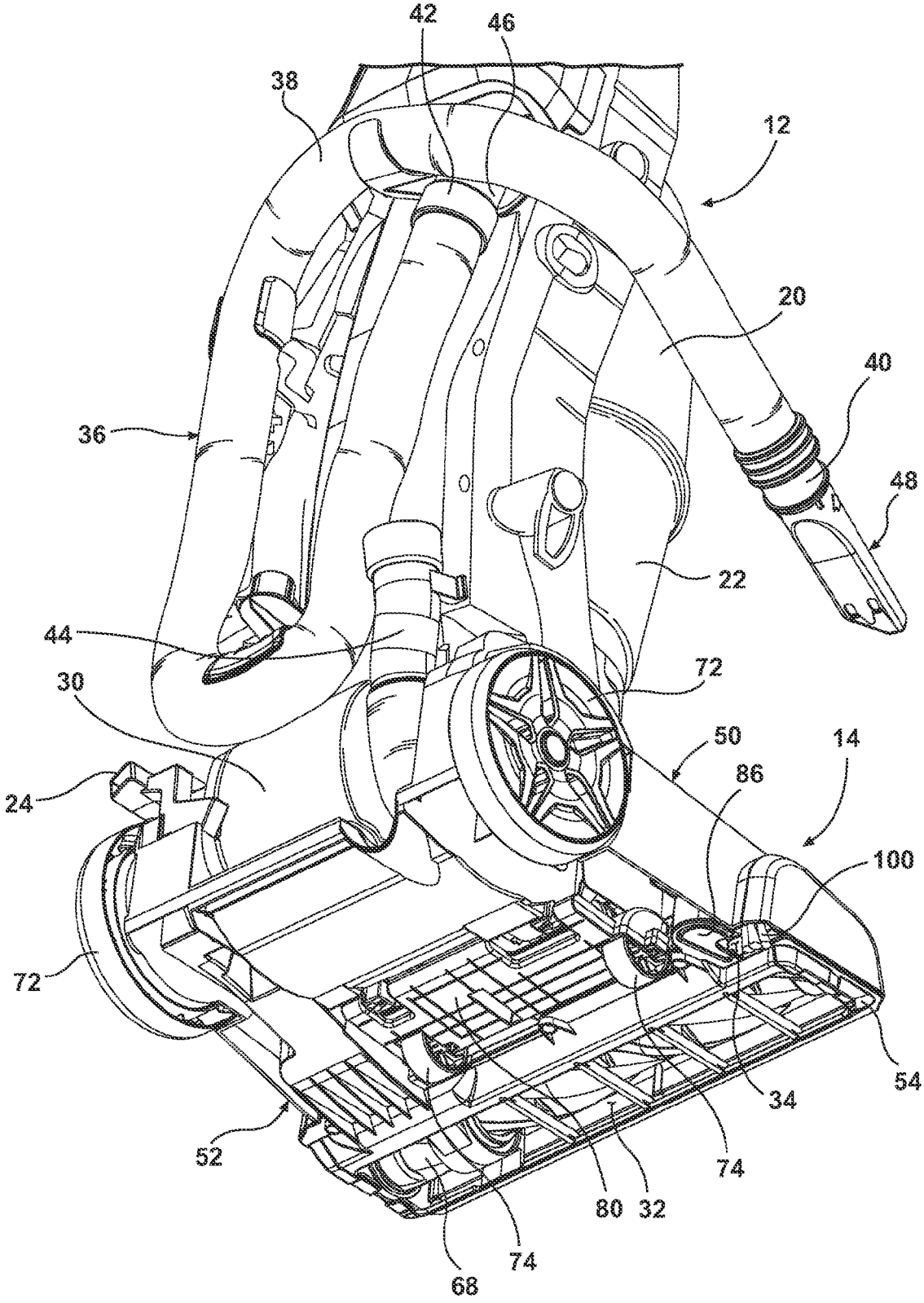
FIG. 3 is a rear perspective view of the vacuum cleaner of FIG. 1, with the live hose assembly illustrated in a second use position.

The live hose assembly 36 can be selectively placed in a second use position shown in FIG. 3, in which the first coupling end 40 of the vacuum hose 38 is removed from hose receiver conduit 44 for above-the-floor cleaning using the first coupling end 40 as the inlet for dirt. The second coupling end 42 remains attached to the inlet duct 46, which places the first coupling end 40 of the vacuum hose 38 in fluid communication with the suction source in the motor cavity 30. A suitable accessory tool 48 can be selectively coupled to the free first coupling end 40 to supplement the cleaning performance of the vacuum hose 38. As shown herein, the accessory tool 48 can comprise a crevice tool configured for cleaning surfaces in small, narrow and/or constricted areas, although different accessory tools 48 can be interchangeably used with the vacuum hose 38. Other examples of suitable accessory tools 48 include an extension wand, a bristle brush, an upholstery brush, or a tool specifically adapted for removing pet hair.

Figure 4:
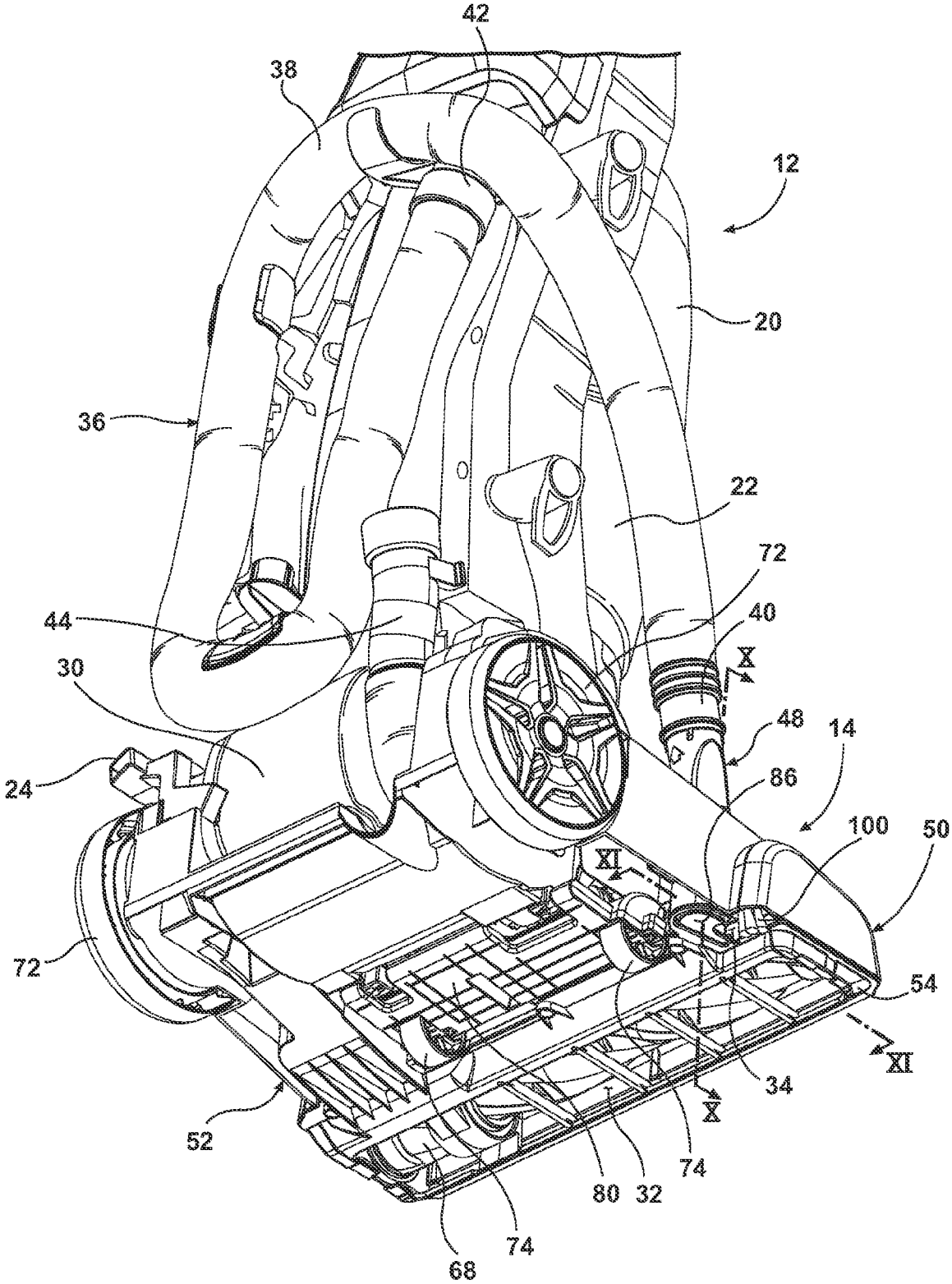
FIG. 4 is a rear perspective view of the vacuum cleaner of FIG. 1, with the live hose assembly illustrated in a third use position.

The live hose assembly 36 can further be selectively placed in a third use position shown in FIG. 4, in which the first coupling end 40 of the vacuum hose 38 is removed from hose receiver conduit 44 and is coupled with the auxiliary suction nozzle 34 for on-the-floor cleaning using the auxiliary suction nozzle 34 as the inlet for dirt. The second coupling end 42 remains attached to the inlet duct 46, which places the auxiliary suction nozzle 34 in fluid communication with the suction source in the motor cavity 30. The vacuum hose 38 can be configured to be indirectly removably coupled to the auxiliary suction nozzle 34 by the accessory tool 48, as shown in the illustrated embodiment, or can be directly coupled to the auxiliary suction nozzle 34 without the use of an accessory tool.

In operation, with the live hose assembly 36 in the first position shown in FIG. 2, the vacuum cleaner 10 draws in dirt-laden air through the vacuum hose 38 via the main suction nozzle 32 and into the collection system 18 where the dirt is substantially separated from the working air. The air flow then passes through the motor cavity 30 and past the suction source prior to being exhausted from the vacuum cleaner 10. With the live hose assembly 36 in the second position shown in FIG. 3, the vacuum cleaner 10 draws in dirt-laden air through the vacuum hose 38 via the first coupling end 40 or accessory tool 48; the remainder of the working air path through the vacuum cleaner 10 is the same. With the live hose assembly 36 in the third position shown in FIG. 4, the vacuum cleaner 10 draws in dirt-laden air through the vacuum hose 38 via the auxiliary suction nozzle 34; the remainder of the working air path through the vacuum cleaner 10 is the same.

Figure 5:
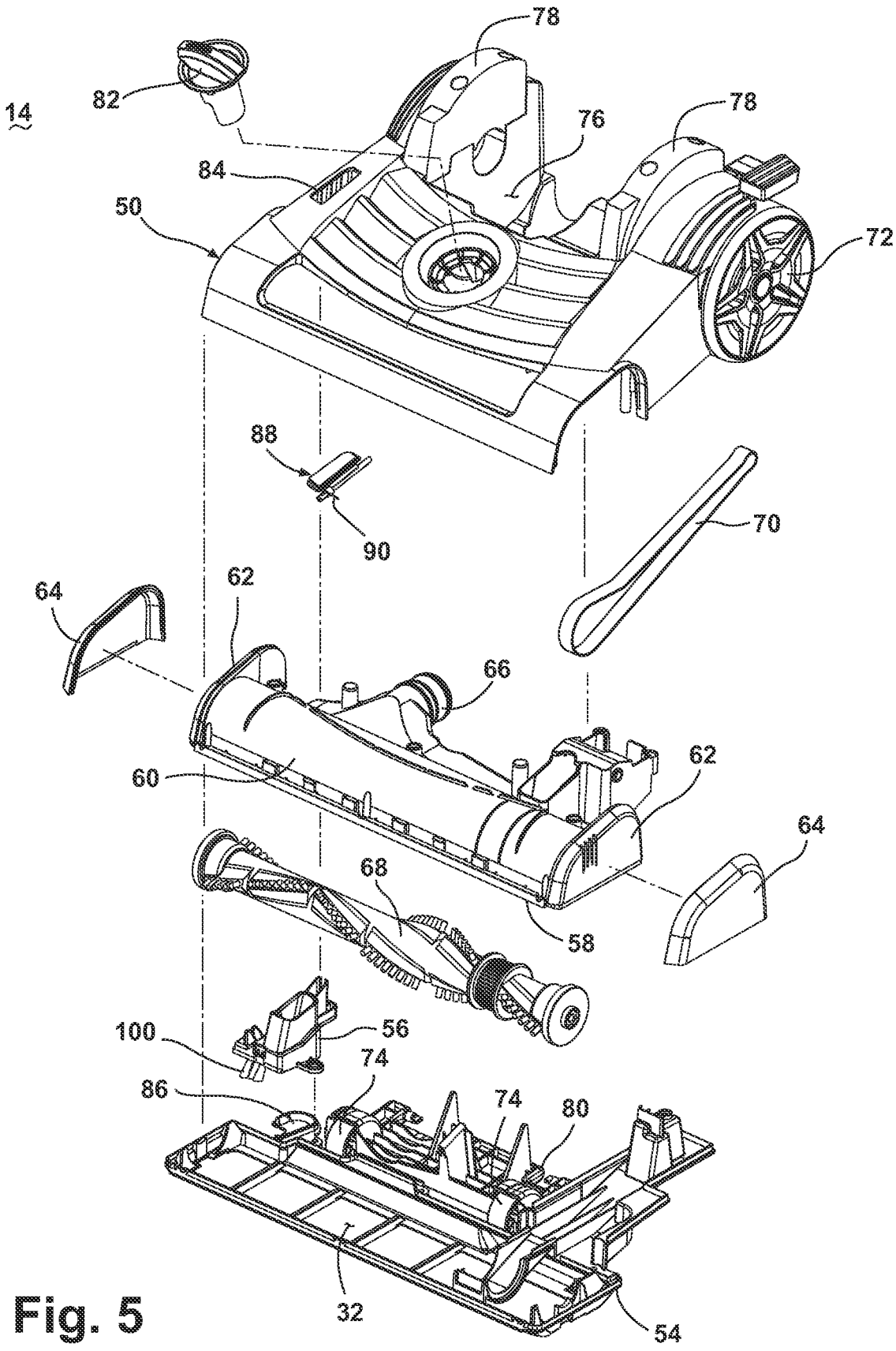
FIG. 5 is an exploded view of the base assembly from FIG. 1.

FIG. 5 is an exploded view of the base assembly 14 from FIG. 1. The base assembly 14 includes an upper housing 50 that couples with a lower housing 52 to create a partially enclosed space therebetween. As illustrated herein, the lower housing 52 can comprise a sole plate 54 and a hose duct 56 mated with the sole plate 54 to form the auxiliary suction nozzle 34 (FIG. 2). An agitator casing 58 is positioned within the upper housing 50 and mates with a portion of the sole plate 54 and of the hose duct 56. The agitator casing 58 comprises an agitator chamber 60 formed between two inner end caps 62. Outer end caps 64 are mounted to the sides of the upper housing 50 around the inner end caps 62. The main suction nozzle 32 is formed by openings in the sole plate 54 that are in fluid communication with the agitator chamber 60. A duct 66 is coupled at one end of the agitator chamber 60 and fluidly communicates with the hose receiver conduit 44 (FIG. 2).

An agitator 68 is positioned within the agitator chamber 60 for rotational movement, and can be coupled to a shaft of a motor/fan assembly (not shown) in the motor cavity 30 (FIG. 1) via a commonly known arrangement including a drive belt 70. Alternatively, a dedicated agitator motor can be provided in the base assembly 14 for driving the agitator 68. The agitator 68 is illustrated as a rotatable brushroll having a plurality of bristles; however, it is within the scope of the invention for other types of agitators to be used, such as a stationary brush or dual rotating brushrolls. The upper and lower housings 50, 52 and the agitator casing 58 can collectively be considered the housing of base assembly 14.

A pair of rear wheels 72 is provided on the upper housing 50 and a pair of front wheels 74 can be provided on the lower housing 52 for maneuvering the vacuum cleaner 10 over a surface to be cleaned. The upper housing 50 further includes a rear cavity 76 for receiving the motor cavity 30 of the upright handle assembly 12. A pair of clamps 78 pivotally secures the upright handle assembly 12 to the upper housing 50. Other common features of vacuum cleaner base assemblies, such as a suction nozzle height adjustment mechanism comprising a rotatable carriage 80 attached to the upper housing 50 on which the front wheels 74 are mounted and which is actuated by a knob 82, can be provided.

The hose duct 56 can be aligned with an auxiliary port 84 provided on a side of the base assembly 14. In the illustrated embodiment, the auxiliary port 84 is formed as an opening in the upper housing 50 and is located rearwardly of the main suction nozzle 32. A platform 86 can extend rearwardly from the sole plate 54 for supporting the hose duct 56 in alignment with the auxiliary port 84. Other positions of the hose duct 56 and auxiliary port 84 are possible, such as closer to or at the median of the base assembly 14, laterally adjacent to the main suction nozzle 32, such as in one of the end caps 62, 64, and/or laterally adjacent to the rear wheel 72. Alternatively, multiple hose ducts and auxiliary ports can be incorporated on the base assembly 14 to provide auxiliary suction nozzles at any location of the base assembly 14. The auxiliary port 84 can be selectively closed by a valve 88 which can be normally biased to a closed position by a spring 90.

Figure 6:
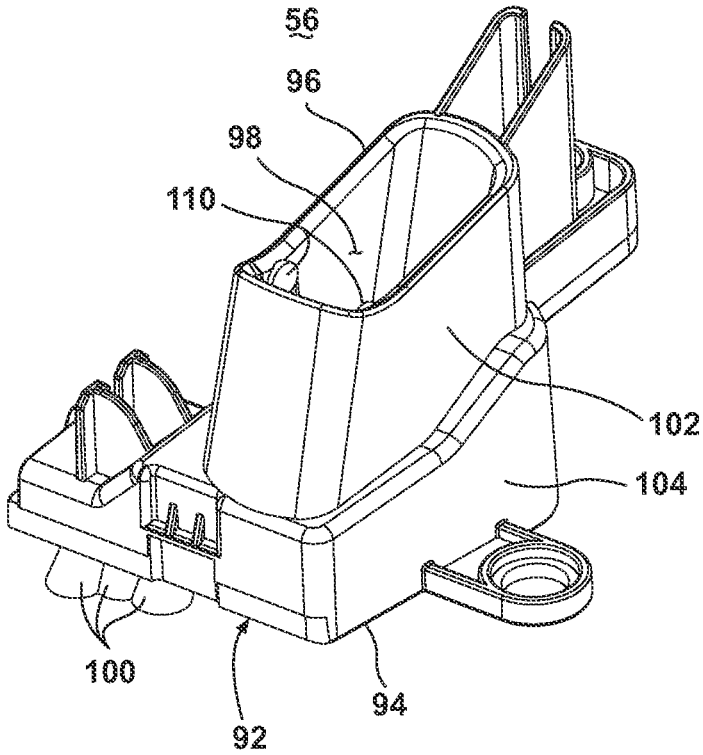
FIG. 6 is a top perspective view of a hose duct of the base assembly from FIG. 5
Figure 7:
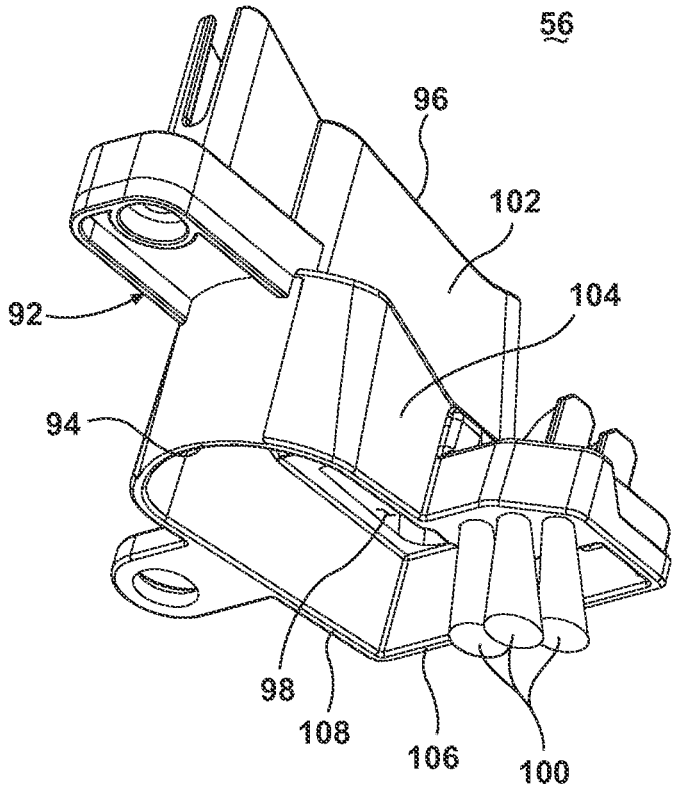
FIG. 7 is a bottom perspective view of the hose duct from FIG. 6.

FIGS. 6 and 7 are top and bottom perspective views of the hose duct 56. The hose duct 56 comprises a duct housing 92 having an inlet opening 94 and an outlet opening 96, with a fluid channel 98 extending therebetween. The duct housing 92 can further be provided with suitable mounting bosses and the like for securely attaching the duct housing 92 to the upper housing 50, using suitable fasteners (not shown). The duct housing 92 can comprise a plurality of bristles 100 projecting downwardly therefrom, adjacent to the inlet opening 94 and which function to dislodge dirt and other debris and guide it toward the inlet opening 94. The duct housing 56 can further include a hose socket 102 which defines the outlet opening 96 of the fluid channel 98 and an inlet chamber 104 formed below the hose socket 102 and which defines the inlet opening 94. The inlet chamber 104 can have a generally L-shaped configuration, with a first front segment 106 joined to a second rear segment 108. The bristles 100 are positioned at a rear side of the first front segment 106. The hose socket 102 can further comprise one or more protuberance(s) 110 within the fluid channel 98 for retaining the accessory tool 48 in the third use position shown in FIG. 4, as will be described below.

Figure 8:
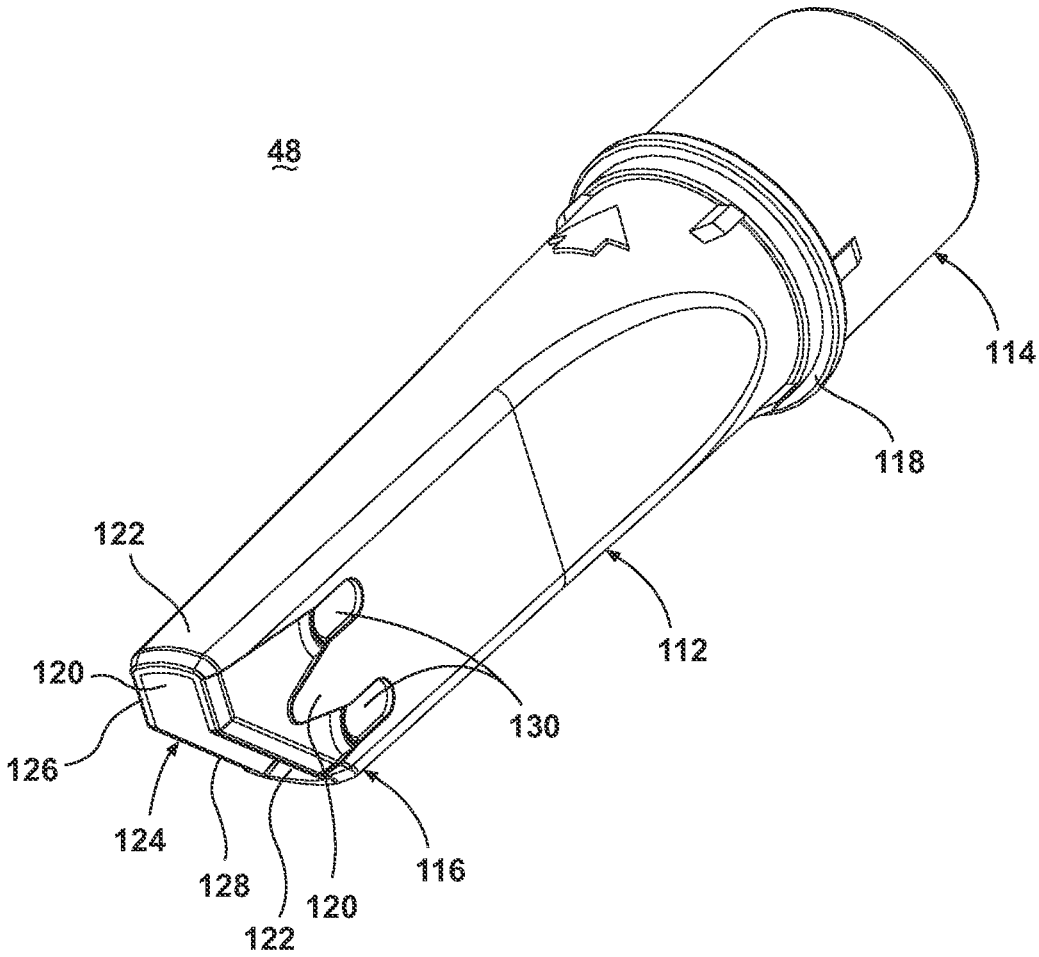
FIG. 8 is a perspective view of a crevice tool for insertion into the auxiliary suction port from FIG. 1.

FIG. 8 is a perspective view of the crevice tool 48, which comprises an elongated body 112 having an insertion end 114 adapted for a friction or interference fit within the first coupling end 40 of the vacuum hose 38, as shown in FIG. 3, and a nozzle end 116 through which air containing dirt and debris is ingested. A circumferential flange 118 on the insertion end 114 provides a stop for the first coupling end of the vacuum hose 38. The shape of the body 112 can gradually transition from having a round or circular cross-section at the insertion end 114 to a narrower or flatter cross-section, such as oval or rectangular, at the nozzle end 116. As such, near the nozzle end 116, the elongated body 112 can include two longer flat surfaces 120 joined by two shorter curved surfaces 122. The nozzle end 116 can be defined by a rim 124 having a flat tip section 126 and an angled section 128 that extends back from the flat tip section 126 toward the insertion end 114. The flat surfaces 120 of the body 112 at the nozzle end 116 can include one or more friction elements 130 which correspond to the one or more protuberance(s) 110 in the hose duct (FIG. 6) and help frictionally retain the crevice tool 48 on the base assembly 14. As shown herein, each flat surface 120 can be provided with a pair of friction elements 130.

Figure 9:
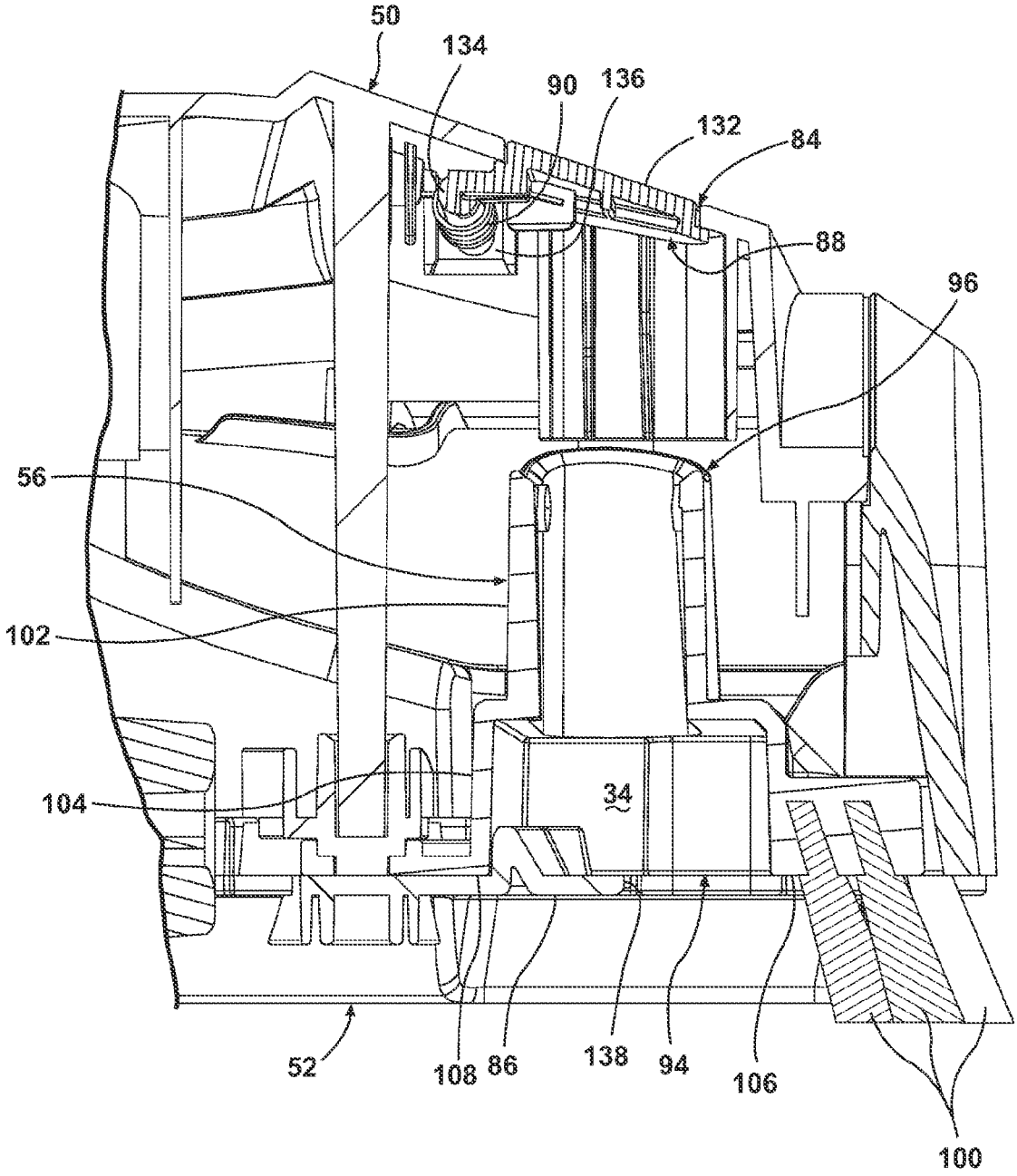
FIG. 9 is a cross-sectional view through line IX-IX of FIG. 1.

FIG. 9 is a cross-sectional view through line IX-IX of FIG. 1. The hose socket 102 of the hose duct 56 is aligned with the auxiliary port 84 provided in the upper housing 50 and the inlet chamber 104 is aligned with the platform 86 on the lower housing 52. As shown herein, the outlet opening 96 of the hose socket 102 and the auxiliary port 84 are spaced from each other, while the inlet opening 94 of the inlet chamber 104 mates with the platform 86 to define the auxiliary suction nozzle opening 34. Specifically, the rear segment 108 of the inlet opening 94 receives a solid portion of the platform 86, which partially covers the rear segment 108. The front segment 106 aligns with an opening formed in the platform 86, and the combined openings define the auxiliary suction nozzle opening 34. Of course, it is within the scope of the invention for the auxiliary suction nozzle opening 34 to be defined entirely by the hose duct 56 or entirely by the platform 86, or by another component.

The valve 88 can comprise a movable closure that is pivotally mounted to the base assembly 14 and that is biased to the closed position against the auxiliary port 84, as shown in FIG. 9, by the spring 90. As shown herein, closure comprises a flap or door 132 having a hinge shaft 134. The hinge shaft 134 is received within a hinge mount 136 provided in the base assembly 14. As shown herein, the hinge mount 136 can be formed on an underside of the upper housing 50, although other locations are possible. The spring 90, which is shown herein as comprising a torsion spring, can be wrapped around a portion of the hinge shaft 134 and bears against the upper housing 50 to normally bias the door 132 to the closed position.

When the valve 88 is in the closed position as shown in FIG. 9, the working air path through the vacuum cleaner 10 can be defined through either the main suction nozzle 32 with the live hose assembly 36 in the first use position shown in FIG. 2, or through the live hose assembly 36 with the live hose assembly 36 in the second use position shown as shown in FIG. 3. Thus, with the valve 88 closed, and depending on whether the live hose assembly 36 is coupled with or removed from the hose receiver conduit 44, the vacuum cleaner 10 can be suitable for on-the-floor using the main suction nozzle 32 as the inlet for dirt or above-the-floor cleaning using the first coupling end 40 or the crevice tool 48 as the inlet for dirt.

Figure 10:
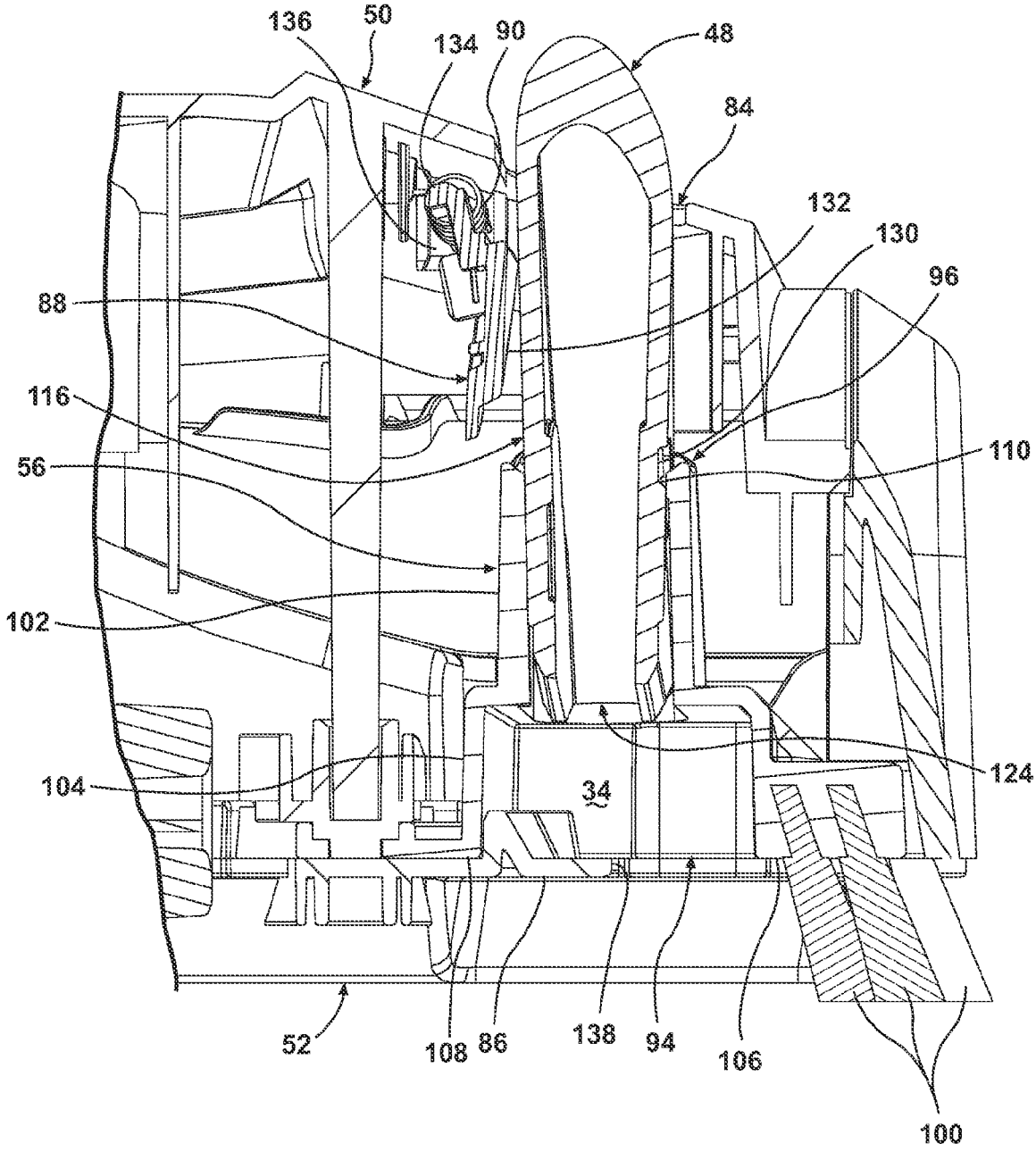
FIG. 10 is a cross-sectional view through line X-X of FIG. 4.

FIG. 10 is a cross-sectional view through line X-X of FIG. 4, illustrating the crevice tool 48 inserted into the auxiliary port 84. The insertion of the crevice tool 48 into the auxiliary port 84 forces the valve from the closed position shown in FIG. 9 to an open position shown in FIG. 10. Specifically, the nozzle end 116 of the crevice tool 48 presses against the upper surface of the door 132 and pivots the door 132 about the hinge shaft 134 away from the auxiliary port 84. The hose socket 102 can be configured to receive the nozzle end 116 of the crevice tool 48, and as such may have a corresponding elongated rectangular or oval shape. When the crevice tool 48 is inserted into the hose socket 102, the friction elements 130 slide past and are retained by the protuberances 110. The engagement can be configured to create an audible click or the like when the friction elements 130 slides past the protuberances 110, so that a user receives a tactile feedback and will know that the crevice tool 48 is in proper position and secured to the hose duct 56.

The crevice tool 48 inserted into the hose socket 102 is in fluid communication with the inlet chamber 104, and establishes a flow path from the auxiliary suction nozzle 34 through the crevice tool 48. Alternatively, the auxiliary port 84 and hose duct 56 can be configured such that no accessory tool 48 needs to be provided with the live hose assembly 36; in this case, the first coupling end 40 of the vacuum hose 38 can be used to open the valve 88 and can be received by the hose duct 56 to establish a flow path from the auxiliary suction nozzle 34 through the vacuum hose 38.

Figure 11:
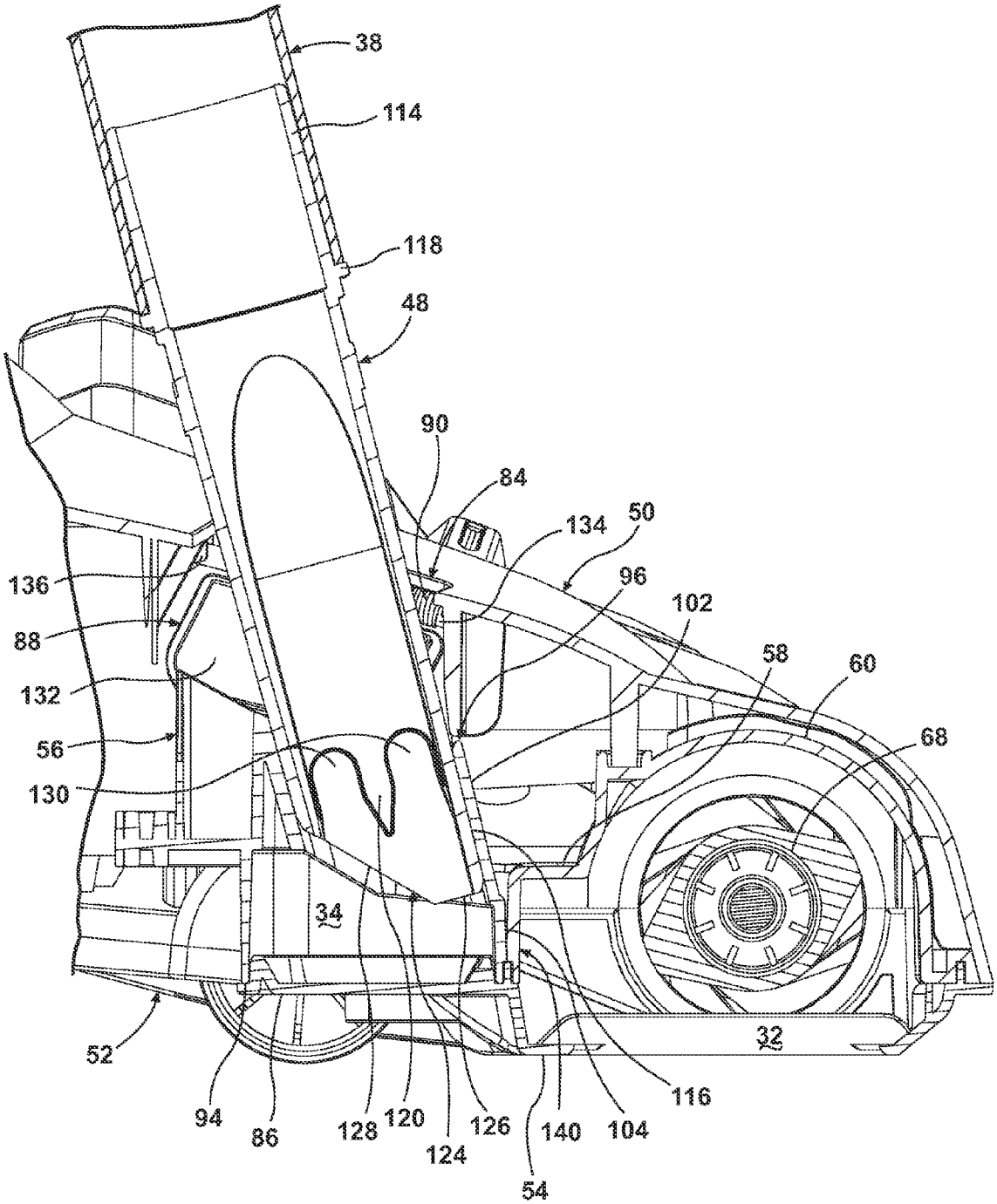
FIG. 11 is a cross-sectional view through line XI-XI of FIG. 4.

FIG. 11 is a cross-sectional view through line XI-XI of FIG. 4. The auxiliary suction nozzle 34 is fluidly isolated from the main suction nozzle 32. As shown herein, a divider in the form of a partition wall 140 can be provided between the main and auxiliary suction nozzles 32, 34 to isolate the fluid path through each nozzle from each other. The partition wall 140 of the embodiment can be formed by mated sections of the sole plate 54 of the lower housing 52 and the agitator casing 58, although other configurations of the partition wall 140 are possible. When the valve 88 is in the open position as shown in FIG. 11, the working air path through the vacuum cleaner 10 can be defined through the auxiliary suction nozzle 34 with the live hose assembly 36 in the third use position, also shown in FIG. 4. Thus, with the valve 88 opened, the vacuum cleaner 10 can be suitable for on-the-floor cleaning using the auxiliary suction nozzle 34 as the inlet for dirt. Since the auxiliary suction nozzle 34 is isolated from the main suction nozzle 32, no vacuum will be generated at the main suction nozzle 32 in this position.

The vacuum cleaner 10 of the embodiment of the invention shown herein offers the auxiliary suction nozzle 34 in addition to the main suction nozzle 32, which expands the effective cleaning path of the vacuum cleaner over prior art vacuum cleaners offering only a main suction nozzle. The auxiliary suction nozzle 34 can have particular use for cleaning along areas of a floor surface that are typically harder with reach with the main suction nozzle 32, such as along edges or baseboards of rooms and near kick plates of cabinetry and appliances. The main suction nozzle 32 and auxiliary suction nozzle 34 are fluidly isolated from each other, which permits the full working air flow of the suction source to be directed to one nozzle at a time, independently, rather than splitting the working air flow between the nozzles which would effectively reduce the suction power at each nozzle. The auxiliary port 84 associated with the auxiliary suction nozzle 34 is normally closed by the valve 88 when not in use, which closes the pathway to the auxiliary suction nozzle 34 and offers an aesthetically pleasing appearance by providing a continuous look to the base assembly 14. Further, the valve 88 is opened by insertion of the live hose assembly 36 into the auxiliary port 84, offering easy and ergonomic operation of the main suction nozzle 32.

While the invention has been specifically described in connection with certain specific embodiments thereof, it is to be understood that this is by way of illustration and not of limitation, and the scope of the appended claims should be construed as broadly as the prior art will permit. The illustrated vacuum cleaner is but one example of the variety of vacuum cleaners with which this invention or some slight variant can be used. While shown and described for use with an upright vacuum cleaner, the live hose can be used with other types of vacuum cleaner, such as "stick"-type upright cleaners, canister vacuum cleaners, robotic vacuum cleaners, hand-held vacuum cleaners, or built-in central vacuum cleaning systems. For example, in a canister vacuum cleaner, the base assembly 14 can be configured as a floor nozzle that is coupled to a canister body via a wand-type handle and a vacuum cleaner hose. The live hose can also be used with vacuum cleaners adapted to dispense and/or take up fluids, such as extractors and steam cleaners. Reasonable variation and modification are possible within the forgoing disclosure and drawings without departing from the scope of the invention which is defined by the appended claims. It should also be noted that all elements of all of the claims may be combined with each other in any possible combination, even if the combinations have not been expressly claimed.

What is claimed is:

1. A vacuum cleaner for cleaning a surface, comprising:

a housing having a main suction nozzle and an auxiliary suction nozzle that is fluidly isolated from the main suction nozzle;

a suction source for generating a working air flow at one of the main suction nozzle and the auxiliary suction nozzle;

a vacuum hose in fluid communication with the suction source and with one of the main suction nozzle and the auxiliary suction nozzle;

a port provided in the housing in fluid communication with the auxiliary suction nozzle, wherein the vacuum hose is removably coupled to the port to fluidly communicate with the auxiliary suction nozzle; and a moveable door provided on the housing and selectively closing the port when the vacuum hose is uncoupled from the port.

2. The vacuum cleaner from claim 1, further comprising a hose receiver conduit in fluid communication with the main suction nozzle, wherein the vacuum hose is removably coupled to the main suction nozzle for on-the-floor cleaning when the vacuum hose is in fluid communication with the main suction nozzle.

3. The vacuum cleaner from claim 2, wherein the vacuum hose comprises an accessory tool adapted to be selectively coupled to the port and the hose receiver conduit.

4. The vacuum cleaner from claim 3, wherein the accessory tool comprises a crevice tool.

5. The vacuum cleaner from claim 1, further comprising a hose duct extending between the auxiliary suction nozzle and the port.

6. The vacuum cleaner from claim 5, wherein the hose duct comprises a hose socket for selectively retaining an accessory tool in the hose duct when the vacuum hose is coupled to the port.

7. The vacuum cleaner from claim 1, wherein the door comprises a valve selectively opening and closing a fluid channel between the auxiliary suction nozzle and the port.

8. The vacuum cleaner from claim 7, wherein the valve is biased to a closed position in which the valve closes the fluid channel.

9. The vacuum cleaner from claim 1, wherein the housing comprises a plurality of bristles located adjacent the auxiliary suction nozzle and configured to guide dirt toward the auxiliary suction nozzle.

10. The vacuum cleaner from claim 1, wherein the housing comprises an upper surface, and the port is provided in the upper surface.

11. The vacuum cleaner from claim 1, wherein the housing comprises a median defined along a plane through the center of the vacuum cleaner that is parallel to a path of travel of the vacuum cleaner, and the port is located laterally of the median.

12. The vacuum cleaner from claim 11, wherein the port is located substantially rearwardly of the main suction nozzle.

13. The vacuum cleaner from claim 1, wherein the housing comprises an agitator cavity in fluid communication with the main suction nozzle, and an agitator provided within the agitator cavity.

14. The vacuum cleaner from claim 13, wherein the agitator comprises a rotatable brushroll.

15. The vacuum cleaner from claim 13, wherein the port is located substantially rearwardly of the agitator cavity.

16. The vacuum cleaner from claim 1, further comprising an upright handle assembly pivotally mounted to the housing.

* * * * *